US007380388B2

(12) United States Patent
Monti

(10) Patent No.: US 7,380,388 B2
(45) Date of Patent: Jun. 3, 2008

(54) APPARATUS FOR FEEDING A BLISTER BAND

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 0 days.

(21) Appl. No.: 11/616,911

(22) Filed: Dec. 28, 2006

(65) Prior Publication Data

US 2007/0151205 A1 Jul. 5, 2007

(30) Foreign Application Priority Data

Jan. 3, 2006 (IT) ..... BO2006A0004

(51) Int. Cl.
*B65B 57/14* (2006.01)
*B65B 35/34* (2006.01)
*B65B 5/10* (2006.01)

(52) U.S. Cl. ..... 53/493; 53/539; 53/246; 53/250

(58) Field of Classification Search ..... 53/539, 53/246, 249, 250
See application file for complete search history.

(56) References Cited

U.S. PATENT DOCUMENTS 2,307,415 A * 1/1943 Malhiot ..... 53/244
3,545,164 A * 12/1970 Middleton ..... 53/539
4,183,192 A * 1/1980 Smaw ..... 53/236
6,510,676 B1 * 1/2003 Gauthier ..... 53/246
2005/0102980 A1 * 5/2005 Hahnel ..... 53/561
2005/0230001 A1 * 10/2005 Monti ..... 141/129

FOREIGN PATENT DOCUMENTS

| | | | |
|---|---|---|---|
| DE | 3842273 | A1 | 6/1989 |
| EP | 1380510 | A1 | 1/2004 |
| EP | 1588944 | A1 | 10/2005 |
| FR | 2785866 | A1 | 5/2000 |

OTHER PUBLICATIONS

European Patent Office, search report for application EP 06126781, completed Apr. 2, 2007.

* cited by examiner

*Primary Examiner*—Stephen F Gerrity
(74) *Attorney, Agent, or Firm*—William J. Sapone; Coleman Sudol Sapone P.C.

(57) ABSTRACT

An apparatus for feeding a blister band moved in a forward direction, with a number of interconnected walls defining a bottom closed by the blister band set in motion, to define a chamber. At least two units are arranged in series and separated by a plate, and operate in the chamber. An article supply leads to each unit of the chamber for feeding articles onto the blister band in motion, while a brush works near the plate and near a fore wall in counter-rotation with respect to the forward direction of the blister band to reject possible articles not entered into the blisters of the band or placed in the blisters in double.

7 Claims, 2 Drawing Sheets

APPARATUS FOR FEEDING A BLISTER BAND

BACKGROUND OF THE INVENTION

The present invention relates to blistering machines, with particular reference to the apparatuses for introducing articles, such as pills, capsules, tablets, into blisters of a corresponding blister band.

DESCRIPTION OF THE PRIOR ART

Known apparatuses for feeding blisters of a blister band act directly on a moving, horizontal or inclined, blister band, and include, e.g.:

- a number of walls, namely rear, fore, upper and lateral walls, with respect to the blister forward direction, connected to one another and supported by the apparatus frame so as to leave a bottom, which is closed by the blister band in motion, to define a chamber;
- a supply of articles, leading to the chamber for feeding articles to the moving blister band;
- a brush working near the fore wall and operated to counter-rotate with respect to the band forward direction, so as to return the articles, which have not been placed inside the blisters or, protruding therefrom, or which have been placed in double therein;
- sensor means, aimed at detecting a bulk of articles accumulated between the walls;
- a central unit, connected functionally to the sensor means for adjusting the flow of articles sent by the article supply.

The rotation axis of the brush is inclined with respect to the direction transversal to the band forward motion, so as to send the exceeding articles to a recycling path, communicating with the article supply, situated beside the brush.

The group formed by the walls and the blister band passing below, define a chamber containing articles delivered by the article supply, aimed at occupying progressively corresponding blisters of the band, while the latter is moving.

Moreover, the chamber communicates with the recycling path, into which a part of the articles rejected by the brush are sent.

In order to ensure filling of all blisters, the article supply releases an exceeding quantity of articles into the area near the rear wall, inside the chamber, where the articles accumulate, dropping in part inside the blisters of the passing band.

A part of the exceeding articles are moved by the moving band toward the brush, which pushes them back, throwing a minimum part of them into the accumulation area and prevailingly into the recycling path.

The recycling path allows a great amassing of articles in the accumulation area, which is necessary to ensure complete filling of the blisters of the band leaving the apparatus.

However, the recycling of a part of articles released by the article supply causes further pushes and reciprocal friction, thus increasing the probability of damage to single articles and thus of rejection of the corresponding blister pack by control means.

Moreover, the recycling system is bulky, its construction is complicated and consequently, expensive.

Another drawback of known apparatuses lies in many downtimes necessary at each production change for the sterilization and/or sanitation of the inner parts, which touched the articles.

In the light of the above considerations, the object of the present invention is to propose an apparatus for feeding a blister band, which can resolve satisfactorily the just reported drawbacks of the known solutions.

SUMMARY OF THE INVENTION

Therefore, the object is to propose a solution, whose construction is simple, reliable, which ensures high productivity and the complete filling of the blisters of the blister band, reducing at the same time the pushes or friction between the articles, which could compromise their integrity.

Another object of the present invention is to propose an apparatus for feeding a blister band, which is modular and easy to assemble and remove to and from other apparatuses, devices and groups of the blistering machine, to which it is associated, for sterilization and/or sanitation operations, allowing its easy substitution in case of e.g. articles production change.

A further object of the present invention is to propose an apparatus, whose costs are relatively low with respect to the advantages, which are to be pursued.

The above mentioned objects are obtained, in accordance with the content of the claims, by an apparatus for feeding articles to blisters of a blister band, with said blister band being moved in a forward direction, below a chamber formed by a number of interconnected walls, namely a rear wall, a fore wall, an upper wall and lateral walls, supported by a frame of said apparatus and leaving a bottom closed by said blister band in motion, the apparatus including at least two work units, arranged in series in said chamber, each work unit of said work units including:

an article supply leading into said chamber for feeding articles onto said blister band in motion in a corresponding accumulation area;

a brush, working downstream with respect to the accumulation area of said articles and operated to counter-rotate with respect to said forward direction of the blister band to push upstream possible articles not entered into corresponding blisters of the band or placed in double into said blisters.

BRIEF DESCRIPTION OF THE DRAWINGS

The characteristic features of the invention are pointed out in the following description of some preferred but not exclusive embodiments, with reference to the enclosed figures, in which.

DISCLOSURE OF THE PREFERRED EMBODIMENT

Figure 1:
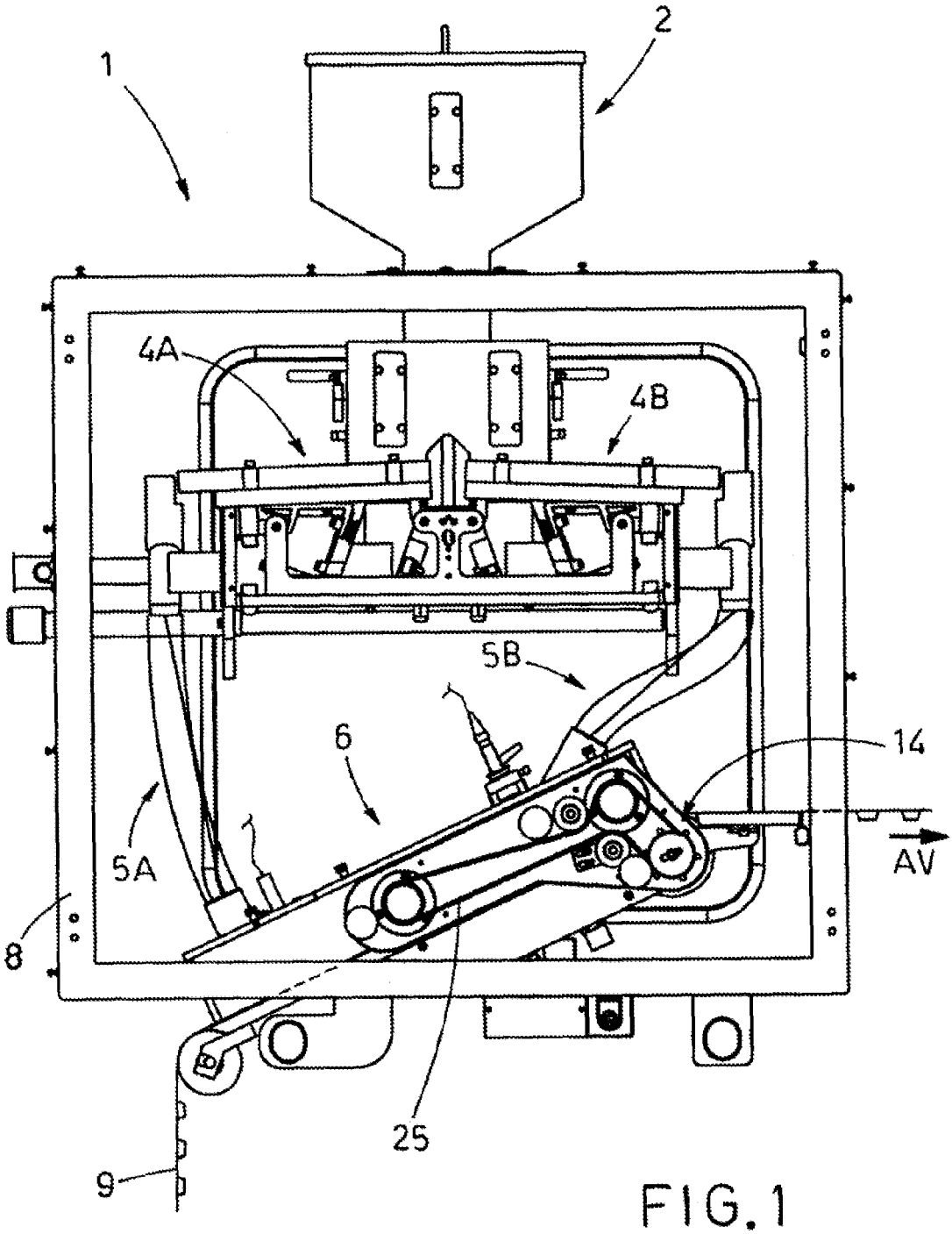
FIG. 1 is a front, schematic view of the apparatus proposed by the present invention.

Having regard to the enclosed Figures, the reference numeral 1 indicates the apparatus proposed by the invention, shown in FIG. 1 as a modular unit aimed at being functionally connected to other groups, devices or apparatuses defining the blistering machine, of which the apparatus is integral part, as well as at feeding a blister band 9, moved and guided in a forward direction AV.

A hopper 2 containing articles 3, such as pills, capsules, tablets, is connected to two vibrating pads, first 4A and second 4B, operated intermittently and subjected to a central unit, non shown.

The two vibrating pads 4A, 4B are connected to two feeding channels, first 5A and second 5B, leading to a chamber 6.

The chamber 6 is defined by a number of walls (FIG. 2), namely a rear wall 7*h*, a fore wall 7*j*, an upper wall 7*k* and lateral walls 7*z* (with respect to the band 9 forward direction AV), connected one to another and supported by a frame 8 of the apparatus 1. The walls leave a bottom, which is closed by the blister band 9 (in the shown example inclined upwards), moved and guided in a forward direction AV, by conveying means 10 of known type.

Two identical units, first 11A and second 11B, working inside the chamber 6, are arranged functionally in a series and separated by a plate 12.

Each of the units 11A, 11B includes:

one of the above mentioned feeding channels 5A, 5B, aimed at feeding articles 3 to the moving blister band 9;

a rotating brush 13A, 13B, which acts near the plate 12 or near the fore wall 7*j*, and whose axis is transversal to the forward direction of the band 9, said brush 13A, 13B. The brush is operated by actuating means 14 so as to counter-rotate with respect to the forward direction AV of the blister band 9;

sensor means 15A, 15B housed in corresponding through holes made in the upper wall 7*k*, aimed at detecting the quantity of articles 3 collected in a relative accumulation area H1, H2 of the chamber 6.

The actuating means 14 operate continuously the rotating brushes 13A, 13B by a transmission belt 25, as shown in FIG. 1.

Now, operation of the apparatus 1 for feeding a blister band 9, proposed by the present invention, will be described.

Figure 2:
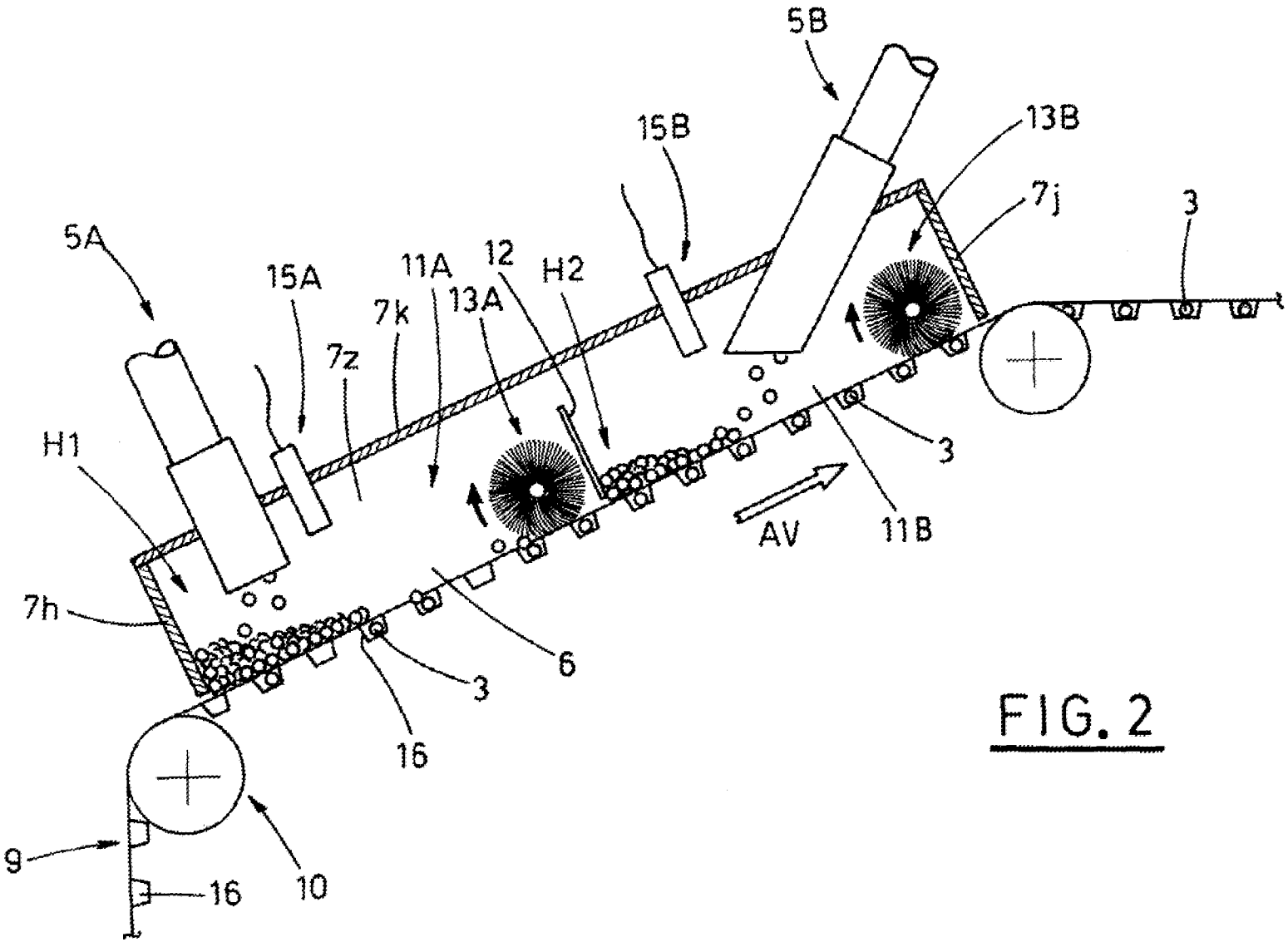
FIG. 2 is an enlarged view, proposed with more details, of an element of FIG. 1 considered particularly significant, some parts of which have been removed to better point out others.

The first feeding channel 5A delivers a certain quantity of articles 3 onto the moving band 9, in a region corresponding to a first accumulation area H1, situated near the rear wall 7*h*, thus causing the filling of the most of the blisters 16 thereof (FIG. 2).

Possible exceeding articles 3 remaining on the blister band 9, in spite of the relative inclination of the latter, or placed in a double number inside the blisters 16, from which they protrude, are pushed toward the first accumulation area H1, by the first brush 13A.

Likewise, a second accumulation area H2 of articles 3 is defined directly downstream of the separating plate 12 and fed by the second feeding channel 5B, which results in filling possible still empty blisters 16.

Also in this case, the exceeding articles 3 are pushed toward the second accumulation area H2.

A control unit, not shown, receives at the input the signals coming from the first and second sensor means 15A, 15B, which detect the quantity of articles 3 collected in the relative first accumulation area H1 and second accumulation area H2.

According to such signals, the central unit modulates the intermittent operation of the corresponding first vibrating pad 4A and second vibrating pad 4B, consequently adjusting the flow of articles 3 through the respective first feeding channel 5A and second feeding channel 5B.

Therefore, in this way, the quantity of articles 3, which defines the first accumulation area H1 and the second accumulation area H2 is always monitored and maintained within prefixed range, optimizing the operation of the working units 11A, 11B.

The presence of at least two working units, first 11A and second 11B, as they have been described from their technical-functional aspect, allows a sure filling of the blisters 16 of the portion of the band 9 leaving the chamber 6.

Actually, the first unit 11A is aimed at filling the major part of the blisters 16 of the blister band 9 in motion, while the second unit 11B is aimed at completing the introduction of the articles 3.

What above is obtained without recycling paths, since the quantity of articles 3 defining each accumulation area H1, H2 is remarkably smaller than the one of the known solutions.

Advantageously, a smaller quantity of articles 3 in the accumulation areas H1, H2 and the lack of a recycling path reduce the probability of pushes and friction, which can put at risk the integrity of articles 3.

Moreover, the lack of a recycling system makes the proposed apparatus simpler and more compact from the construction point of view.

Another advantage of the proposed feeding apparatus, shown in a modular unit in FIG. 1, lies in the fact that it can be removed from other devices, groups or apparatuses of the blistering machine, of which it is integral part, for sterilization and/or sanitation operations, in a simple, rapid and intuitive way, thus allowing a reduction of downtimes.

A further advantage of the present invention derives from the fact that it defines an apparatus for feeding a blister band, whose costs are relatively low with respect to the obtained advantages.

It is specified that with some types of articles 3, in particular non rolling, the functionality of the separating plate 12 disappears, therefore it can be omitted without any risk for the advantageous technical-functional aspects of the invention.

It is also evident that the present invention can be extended in analogous way, in accordance with the above description, also to the apparatuses having more than two identical working units, arranged in series.

It is understood that the proposed invention has been described, with reference to the enclosed figures, as a mere, not limiting example. Therefore, it is obvious that any changes or variants applied thereto remain within the protective scope as described above and claimed below.

What is claimed is:

1. An apparatus for feeding articles for filling blisters of a blister band, said blister band being moved in a forward direction, the apparatus comprising:

a frame;

a bottomless chamber supported by said frame, the bottomless chamber being located in close proximity to said blister band, the bottom of said chamber being closed by the blister band moving in the forward direction;

a first work unit and a second work unit, arranged in series within said bottomless chamber;

said first work unit including:

a first article supplying channel situated above a first accumulation area of said blister band for feeding articles onto said blister band moving in the forward direction, articles being collectable in said first accumulation area in a first quantity of articles;

first sensor means located near said first article supplying channel for detecting a level of said first quantity of articles collected in the first accumulation area; and a first brush situated downstream from the first accumulation area and operated to counter-rotate with respect to said forward direction of the blister band to push upstream articles which have been not been properly received within blisters of the blister band;

said second work unit, located downstream of said first work unit with respect to the forward direction of the blister band, including;

a second article supplying channel situated above a second accumulation area of said blister band, for feeding articles onto said blister band moving in the forward direction, articles being collectable in said second accumulation area in a second quantity of articles;

second sensor means located near said second article supplying channel for detecting a level of said second quantity of articles collected in the second accumulation area; and a second brush situated downstream of the second accumulation area and operated to counter-rotate with respect to said forward direction of the blister band to push upstream articles which have not been placed properly within blisters of the blister band;

an article supply source;

a first adjusting means connected to the article supply source for adjusting the flow of articles delivered to said first article supplying channel;

a second adjusting means connected to the article supply source for adjusting the flow of articles into said second article supplying channel;

the first adjusting means being responsive to said first sensor means for adjusting the supplying of articles to the first article supplying channel, so that said first quantity of articles in said first accumulation area is maintained at a level which will not allow a complete filling of the blisters of the blister band; and the second adjusting means being responsive to the second sensor means for adjusting the supplying of articles to the second article supplying channel so that said second quantity of articles in said second accumulation area is maintained at a level to provide complete filling of the blisters of the blister band.

2. An apparatus, according to claim 1, wherein said first work unit and said second work unit are separated by a plate.

3. An apparatus, according to claim 1, wherein the article supply source includes a hopper, and the first article supplying channel and the second article supplying channel are connected to said hopper for feeding said articles thereto.

4. An apparatus, according to claim 3, wherein said first means for adjusting the flow of articles and said second means for adjusting the flow of articles include vibrating pads, intermittently operated by a control unit.

5. An apparatus, according to claim 1, wherein a part of said blister band moving forward beneath the first and second working units is inclined upwards with respect to the forward direction of the blister band.

6. An apparatus, according to claim 1, wherein said rotating brushes are operated continuously by a transmission belt driven by actuating means.

7. An apparatus, according to claim 1, further comprising a control unit for receiving signals from the first sensor means and the second sensor means, for detecting the quantity of articles in the first accumulation area and the second accumulation area, respectively, the control unit intermittently communicating with the first adjusting means and the second adjusting means for operating the first and second adjusting means as needed to adjust the flow of articles delivered to the first and second article supplying channels, respectively, to maintain the levels of the first quantity of articles and the second quantity of articles, respectively.

* * * * *